United States Patent [19]

Schad et al.

[11] Patent Number: 4,623,035

[45] Date of Patent: Nov. 18, 1986

[54] MUFFLER OF THE SOUND REFLECTING TYPE FOR USE WITH INTERNAL COMBUSTION ENGINES

[75] Inventors: Kurt Schad; Hans-Joachim Gora, both of Bischofsheim, Fed. Rep. of Germany

[73] Assignee: General Motors Corporation, Detroit, Mich.

[21] Appl. No.: 704,684

[22] Filed: Feb. 22, 1985

[30] Foreign Application Priority Data

Feb. 22, 1984 [DE] Fed. Rep. of Germany ..... 3406282

[51] Int. Cl.[4] ..... F01N 1/08

[52] U.S. Cl. ..... 181/274; 181/265; 181/281; 181/282

[58] Field of Search ..... 181/253, 265, 267, 269, 181/274, 279, 281, 282

[56] References Cited

U.S. PATENT DOCUMENTS

| | | | |
|---|---|---|---|
| 3,191,715 | 6/1965 | Jettinghoff | 181/269 |
| 3,469,652 | 9/1969 | McLellan | 181/253 |
| 4,126,205 | 11/1978 | Bauerschmidt | 181/279 X |
| 4,136,757 | 1/1979 | Bauerschmidt | 181/279 X |

*Primary Examiner*—Benjamin R. Fuller
*Attorney, Agent, or Firm*—R. L. Phillips

[57] ABSTRACT

A muffler is disclosed comprising a closed housing having an annular inlet and an annular outlet neck, and the housing having arranged therein a pair of axially extending pipes which are at least partially overlapping one another. One of the pipes is connected to the inlet neck and has a circumferentially arranged passageway to permit the exhaust gases to be directed from the inlet neck to the inside of the housing. The other pipe is connected to the outlet neck and has a circumferentially arranged passageway to permit the exhaust gases to be directed from inside the housing to the outlet neck.

27 Claims, 2 Drawing Figures

MUFFLER OF THE SOUND REFLECTING TYPE FOR USE WITH INTERNAL COMBUSTION ENGINES

TECHNICAL FIELD

The invention relates to a muffler of the sound reflecting type for use with internal combustion engines.

BACKGROUND OF THE INVENTION

In accordance with the principles of acoustically reflective sound attenuation, a sound reflecting baffle means is provided in the sound conducting conduit in such a way that a relatively large portion of the sound wave is cancelled out by the interference of the reflecting sound wave with the incident sound wave. It should be appreciated that such baffle means may be in the form of walls disposed in the propagating path of the sound wave, or in the form of cross-sectional restrictions provided in the sound conducting conduit. Therefore, in its simplest form, an acoustically reflective silencer is comprised of a housing having a relatively large diameter cross-section and an inlet and outlet neck of reduced diameter connected to the housing.

Furthermore, silencers for use with internal combustion engines serve to smoothen the pulsating flow of the exhaust gases produced in the exhaust system by the internal combustion engine, and to reduce the muzzle noise which is generated, primarily, by the ignition noise. The problem of sound attenuation in internal combustion engines is compounded by the circumstance that the critical sound spectrum of exhaust gases is relatively broad; i.e. in the area of 50 to 1,000 Hz, which is the reason that the ordinary engine exhaust gas muffler is a component of relatively complex structure, and that in some instances a number of silencers must be connected in series if they are to cover the entire critical sound spectrum.

The effectiveness of mufflers operating on the sound reflecting principle may be further increased by the provision of exhaust gas flow control means which will result in throttling effects.

A sound reflecting muffler of the type described in the foregoing is disclosed in U.S. Pat. No. 3,191,715. In this prior art muffler, the pipes connected, respectively, to the inlet and the outlet extend transversely through the housing axis. This is to provide for the incoming exhaust gases traveling a distance that corresponds to about three times the length of the housing before exiting through the outlet of the housing. The principal portion of the exhaust gases flow along the pipe connected with the inlet and will issue from the open end of this pipe at about midway of the housing. The gases are then reflected off the housing wall, are redirected between the pipes and the housing walls and towards the inlet opening and, after reversing their flow direction once more, are directed at a location approximately midway of the muffler, into the open end of the pipe connected with the muffler outlet. A substantially smaller portion of the exhaust gases are caused to travel directly from the housing inlet to the housing outlet by way of slots provided in the pipes so as to permit expansion of pulsating exhaust gases and to reduce the flow resistance.

This prior art sound reflection type muffler is only effective within a relatively small, medium frequency range of the sonic spectrum. Furthermore, the smoothening of the pulsating gases is incomplete. The procedure of incorporating the entire housing wall into the reflection system adversely affects the attenuating value of this muffler, because a substantial portion of the exhaust noise is transmitted by way of the housing wall into the environment.

Another engine exhaust muffler of the sound reflecting type has been disclosed in German Pat. DE-PS No. 617,831. The housing of this muffler is provided with slanted boundary surfaces and is partitioned into a number of chambers which are interconnected by pipes of varying diameters. Each individual chamber is adapted to attenuate one particular, relatively small threshold range of the sound spectrum. By virtue of the particular pipe arrangement, the individual attenuating range of each chamber is somewhat enlarged above the chamber threshold frequency. Nevertheless, even in this arrangement the stepwise attenuating procedure is not being eliminated and, like in the preceding arrangement, a considerable portion of the exhaust noise is radiated from the housing walls into the environment.

The auxiliary silencer disclosed in the German Pat. DE-PS No. 626,321, too, is characterized by the partitioning of the muffler housing. In this arrangement, the only partitioning wall has inserted therein two orthogonal pipes of different length. One of the pipes is inserted at one end into the partition wall at the level of the housing inlet. This arrangement is said to provide that with increasing engine speeds, the pipe disposed oppositely of the inlet is sufficient to a diminishing degree to provide for a smooth passage of the exhaust gases, so that the gases are rerouted and forced to travel through the pipe that is not aligned with the inlet opening, which is to provide an equalizing effect in the sound attenuation. However, one drawback of this auxiliary silencing device is that the flow resistance will increase as the engine speed increases, which will adversely affect the operation of the engine. Another shortcoming of this auxiliary device is that the sound attenuating effect is limited to a very narrow frequency range.

The muffler disclosed in U.S. Pat. No. 3,469,652 is designed primarily to smoothen the pulsating exhaust gases. The muffler housing itself is tuned to the low-frequency portion of the sound spectrum and is acoustically coupled to a pair of curvilinear tubes extending between the inlet and the outlet which, in turn, are connected at a point adjacent the inlet and outlet to a curvilinear tube connecting the inlet with the outlet. While this muffler provides satisfactory smoothening of the pulsating exhaust gases, the sound attenuation achieved with this arrangement covers only a very narrow range and, like in the prior art systems described earlier, a substantial portion of the noise spectrum is radiated through the housing wall into the ambient air.

SUMMARY OF THE PRESENT INVENTION

The present invention provides a muffler of the general type described above but which is capable of attenuating a wide range of the critical exhaust gas noise spectrum and which will smoothen the pulsating flow of the exhaust gases in a satisfactory manner. While accomplishing these objectives, the muffler according to the invention is compact in design, economical in manufacture, and the number of required components, which are simple in structure, is relatively small. The muffler construction according to the invention also renders the housing more resistant against corrosion and/or burn-through damage.

These objectives are achieved with gas passage openings in the pipes that are disposed only on the sides facing the respective other pipe, with first reflecting shells which are arranged opposite of the gas passage openings formed in the pipe, and with a pair of second reflecting shells which are disposed opposite the first reflecting shells and on the side opposite of the gas passage openings formed in the pipes. This arrangement provides that the sound waves of the exhaust gases are reflected within a very limited space and in a variety of ways, and that with each reflection the sound waves are confronted with a new obstruction or a passage of different cross-section, which result in a broad band attenuation of the sound waves.

The flow of exhaust gases, after entering into the housing, is thus split up and directed by means of the reflective shells into the two pipes and is combined again in the vicinity of the housing outlet so that the multi-frequency sound waves are subjected to a further path difference and thereby to further noise attenuating cancellations. Since the flow of exhaust gases is conducted, for the most part, between the reflecting shells of the two pipes, noise radiation through the housing walls is considerably reduced.

Furthermore, the tortuous path traveled by the pulsating exhaust gases provide for a substantial smoothening of the exhaust gas oscillations. And all these benefits are realized with a muffler that is of a relatively compact and space-saving design, and with components that are pipe-shaped or of pipe-like configurations; i.e. components that are available at low cost and economical to manufacture.

Preferably, the passage openings extend over substantially the entire length of the pipes and are in the form of rectangular windows. This arrangement provides for the sound waves and the exhaust gases to be reflected and/or conducted over the entire pipe length between the pipes and the reflecting shells, as well as between the pair of pipe-shaped reflecting shell systems, thereby further improving the attenuating effect and the exhaust gas smoothening. Due to the fact that the pipes are open over essentially their entire length, they do not impede the flow of the exhaust gases, which eliminate adverse effects on the operation of the engine caused by back pressure.

Furthermore, the pipes preferably extend over substantially the entire length of the housing and in an overlapping relationship between parallel extending end plates of the housing. This arrangement provides for the sound waves, even with pipes having relatively large openings, to be conducted only between the pair of reflection shell systems so that no sound will be radiated from the housing walls. Then to prevent radiation of exhaust noise through the housing end plates with which the pipes are sealingly connected at their respective ends opposite the inlet and outlet necks, the pipes are provided with circumferentially closed end portions which, preferably, are of relatively short length.

According to a further significant feature of the invention, the pipe axes extend at an acute angle to one another, with the angle formed by the pipe axes ranging between 3° and 45°, preferably about 30°, and the vertex being located on the inlet side. Thus, the pipes diverge in the direction from the inlet side to the outlet side, so that the path travelled by the gases between one shell reflection system and the other becomes progressively larger in the direction towards the outlet side. As a result, the critical noise spectrum is not only attenuated over a wide band, it is also attenuated very uniformly.

Preferably, the first reflecting shells are of pipe-like configuration and are provided, on the sides facing away from the passage openings of the pipes, with reflection windows which extend over nearly the entire length of the shells. These windows, when viewed in plan view, are of rectangular configuration, and the aperture angle relative to the shell axis is between 45° and preferably about 60°. Preferably, the ends of the first reflective shells are sealingly connected with the housing end plates and are provided with short, circumferentially closed end portions whose length corresponds, preferably, to the length of the end portions of the pipes. One characteristic feature of the invention resides in the axes of the first as well as the axes of second reflecting shells each extending so as to form respective acute angles, and with the angle formed by the first pair of reflective shells being smaller than the one formed by the pipe axes, while the angle formed by the second pair of reflecting shells is smaller than the one formed by the first pair of reflecting shells. Preferably, the axes of the first pair of reflecting shells are concident with the axes of the pipes on the inlet side, whereas the axes of the second reflecting shells are concident, essentially, with those of the first reflecting shells on the outlet side. Furthermore, the pipes are preferably located essentially inside the first sound reflecting shells.

The second sound reflecting shells, which are sealingly connected at their ends with the end plates of the housing, are provided with open sections which, preferably, are disposed on the side opposite the associated sound reflecting shell windows, with the aperture angles of the second sound reflecting shells being smaller than 180°; i.e. preferably on the order of 90°. Preferably, the first sound reflecting shells are only partially disposed inside the second sound reflecting shells in such a manner that in the space between the first reflecting shells and the longitudinal edges defining the opening sections of the second reflecting shells there is provided a pair of open sections which are separated from one another.

DESCRIPTION WITH REFERENCE TO THE DRAWINGS

The invention will now be further described in conjunction with the drawings wherein.

Figure 1:
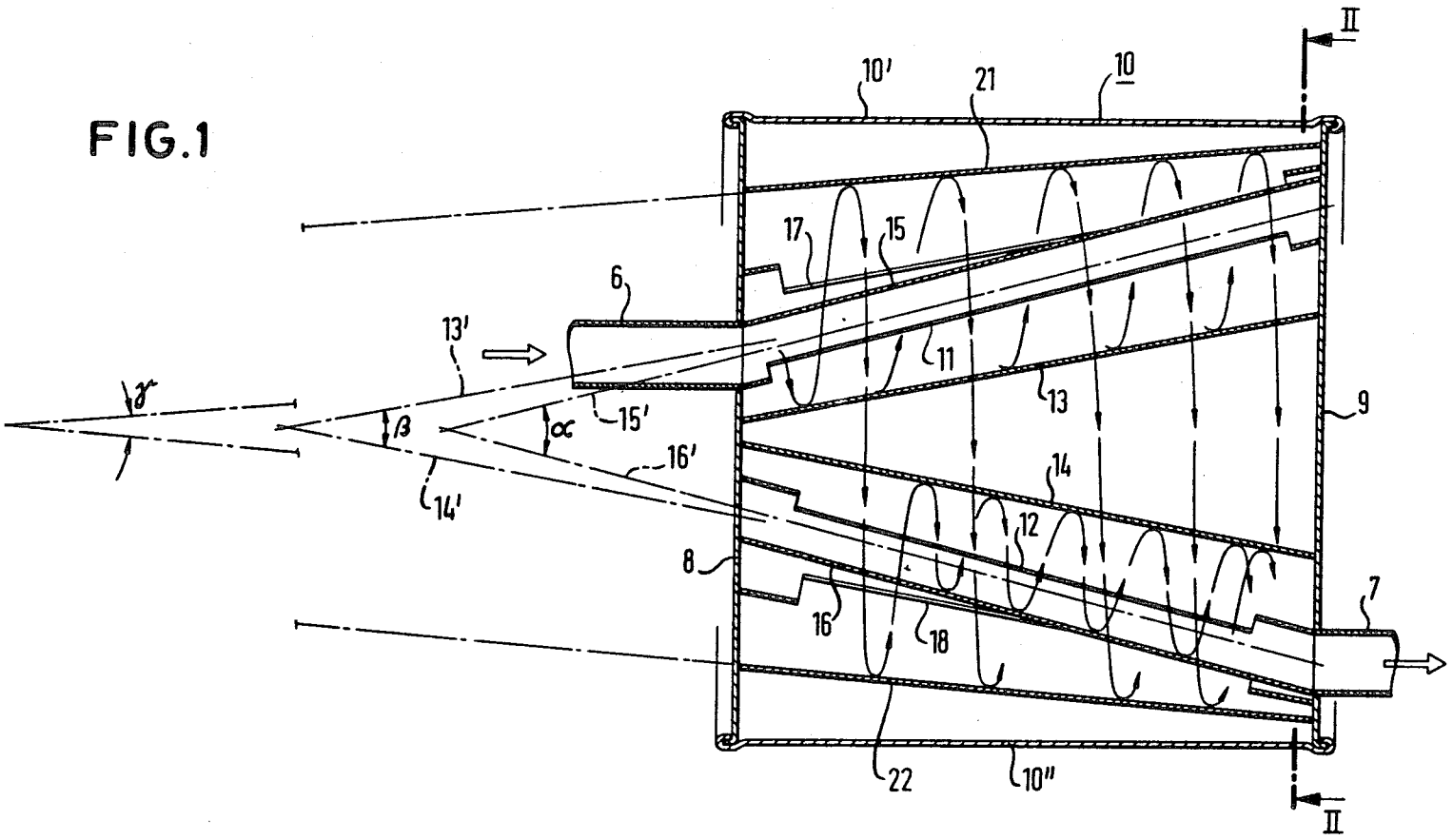
FIG. 1 is a longitudinal sectional view of the preferred embodiment of the sound reflecting muffler according to the present invention.

In FIG. 1, the flow path of the exhaust gases is indicated by arrows. The exhaust gases coming from the exhaust system of the engine, enter the sound reflection type muffler through the inlet neck 6 disposed in the upper portion of a flat inlet end plate 8 of the muffler housing 10 and exit the muffler through an outlet neck 7 disposed in the lower portion of an outlet end plate 9, which is spaced at a distance from the inlet end plate 6 and extends parallel thereto, and which is essentially of the same configuration as the inlet end plate 6. Between the two end plates 8, 9, the housing 10 is comprised of a pair of cylindrical half-shell members 10', 10'' whose open sides are arranged so as to face one another. A pair of flat side walls 4, 5 which are arranged parallel to one another, extend between the half-shell members. A pipe 15 connected with the inlet neck 6 extends upwardly at an angle from the inlet end plate 8 through the muffler housing 10 to the outlet end plate 9 to which it is sealingly connected. A second pipe 16 connected with the outlet neck 7 is also angled upwardly and extends from the oulet end wall 9 to the inlet end wall 8 to which it is sealingly connected. Thus, the two pipes 15 and 16 completely overlap one another and extend parallel to the housing walls 4, 5. The pipe axes 15', 16' intersect one another at a point to the left of the inlet end plate 8 and form there an acute angle $\alpha$ of about 30°. The spacing of the pipes 15, 16 on the inlet end plate 8 is such as to allow for the accommodation of the first sound reflecting shells 13, 14 which will be further described later.

On the sides of pipes 15, 16 that are facing one another there are provided rectangular windows 11, 12 which extend essentially over the entire pipe length, and wherein the aperture angle $\alpha$ of the windows relative to the pipe axes 15', 16' is approximately 60°. However, the pipes are provided with a short circumferentially closed end portion as shown.

Each of the pipes 15, 16 is surrounded at a progressively increasing distance by a first sound reflecting shell 13 and 14, respectively, and a second sound reflecting shell 21 and 22, respectively, each of the reflecting shells being connected at their respective end faces with the end plates 8 and 9, respectively.

The first pair of sound reflecting shells 13, 14 are pipe-shaped and surround the associated pipe 15 and 16, respectively. They are provided on the sides facing away from the windows 11, 12 of the pipes 15, 16 with rectangular windows 17, 18 which extend over nearly the entire length of the housing 10 and which have an aperture angle of about 90° with respect to the shell axis 13', 14'. The second sound reflecting shells 21, 22 extend over an angle of about 270° and are arranged such that their closed side is disposed radially opposite of the windows 17, 18. The first sound reflecting shells 13, 14 extend through the open side of the second sound reflecting shells 21, 22 and are spaced at a distance from the longitudinal edges 21', 22'' thereof. This arrangement provides axial through-openings 19, 19' and 20, 20' respectively.

The axes of the first and second sound reflecting shells 13, 14 and 21, 22, respectively, extend essentially in the same plate as the axes 15', 16' of the pipes 15, 16 and intersect one another at a point to the left of the inlet end plate 8. The angle $\beta$ formed by the axes 13', 14' of the first sound reflecting shells 13, 14 is smaller than the angle $\alpha$ formed by the axes 15', 16' of the pipes and amounts to about 25°. On the other hand, the second sound reflecting shells 21, 22 extend so as to form an acute angle $\gamma$ with one another which, in turn, is smaller than the angle $\beta$ formed by the first sound reflecting shells 13, 14 and which amounts to about 10°.

Figure 2:
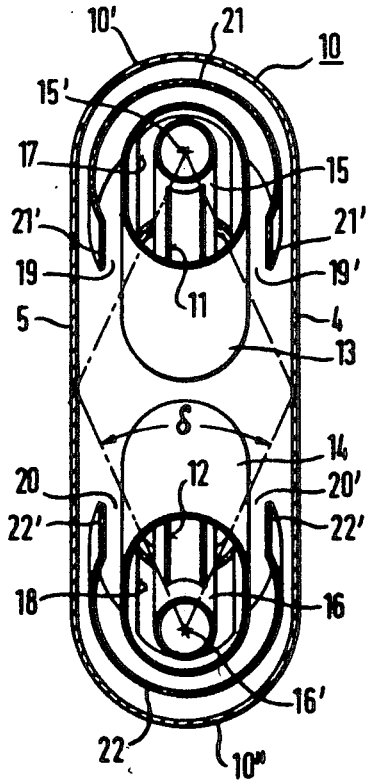
FIG. 2 is a sectional view along line 2—2 of FIG. 1.

The following is a description of the flow path of the exhaust gases, reference being made to FIGS. 1 and 2 of the drawings.

The exhaust gases, after entering the muffler housing 10 through the inlet neck 6, flow into the pipe 15 and exit through the window 11. The gases are then alternately deflected back and forth between the pipe 15 and the first sound reflecting shell 13 while, at the same time, traveling toward the outlet end plate 9 and being partially directed through the first reflection shell 13 and to the windows 17 thereof. After passing through window 17, the gases strike the second reflecting shell 21 and are deflected or redirected from there to the open spaces 19, 19'. From there, the gases flow to the open spaces 20, 20' of the second reflecting shell 22. After being deflected from or redirected by the second reflecting shell 22, the gases pass through the window 18 and, after being redirected by the first reflecting shell 14, the gases travel through the window 12 and enter the pipe 16 while being subjected to multiple reflections. After traveling through pipe 16, the gases finally enter the outlet neck 7.

The many interferences occurring in each of the shell systems as well as from one shell system to the other prevent, by virtue of the novel arrangement, the formation of static waves inside the muffler housing. The alternate flow paths traveled by varying amounts of exhaust gases inside the muffler housing results in a great number of sound wave cancellations which ensures effective and uniform attenuation of the critical exhaust gas noise spectrum.

The above described preferred embodiment is intended to be illustrative of the present invention which may be modified within the scope of the appended claims.

The embodiments of the invention in which an exclusive property of privilege is claimed are defined as follows:

1. Baffle silencer for internal combustion engines, comprising an enclosed housing which is provided with inlet and outlet pipe connections and in which are arranged in an axial direction at least two partially overlapping tubes, one of which is connected to the inlet pipe connection and comprises an open zone on its circumference through which the exhaust gases pass from the inlet pipe connection into the interior of the housing, and the other of which is connected to the outlet pipe connection and comprises on its circumference an open zone through which the exhaust gases pass out of the housing to the outlet pipe connection, characterized by the open zones being provided only on the sides opposite the respective other tube, first sound reflecting shells arranged respectively opposite the open zones and second sound reflecting shells disposed respectively opposite the first sound reflecting shells on the side of the tubes remote from the open zones.

2. Baffle silencer according to claim 1, further characterized by the open zones extending essentially over the whole length of the tubes.

3. Baffle silencer according to claim 2, further characterized by the open zones being in the form of rectangular openings.

4. Baffle silencer according to claim 3, further characterized by the openings having an aperture angle relative to the tube axes between 40° and 60°.

5. Baffle silencer according to claim 4, further characterized by the tubes being arranged in overlapping relationship essentially over the whole length of the housing.

6. Baffle silencer according to claim 5, further characterized by the tubes being each sealingly connected to the housing by an end of the respective tubes remote from the inlet or outlet pipe connection respectively.

7. Baffle silencer according to claim 6, further characterized by the tubes having a circumferentially closed end regions.

8. Baffle silencer according to claim 6, furhter characterized by the tube axes extending at an acute angle to each other.

9. Baffle silencer according to claim 8, further characterized by the acute angles formed by the tube axes being between 3° and 45°.

10. Baffle silencer according to claim 8, further characterized by the apex of the acute angles being on the inlet side.

11. Baffle silencer according to claim 1, further characterized by the first sound reflecting shells being of tubular construction and comprising on the side facing away from the open zones of the tubes, an opening extending approximately over the whole length of the baffle.

12. Baffle silencer according to claim 11, further characterized by the sound reflecting shell openings having a rectangular shape in plan view.

13. Baffle silencer according to claim 11, further characterized by the aperture angle of the sound reflecting shell openings relative to the respective sound reflecting shell axis being between 60° and 90°.

14. Baffle silencer according to claim 11, further characterized by the first sound reflecting shells having ends sealingly connected to the housing.

15. Baffle silencer according to claim 11, further characterized by the first sound reflecting shells having relatively short, circumferentially closed end regions, the length of which is approximately equal to the length of corresponding end regions of the tubes.

16. Baffle silencer according to claim 5, further characterized by the first sound reflecting shells extending at an acute angle to each other between 15° and 35°.

17. Baffle silencer according to claim 16, further characterized by the angle formed by the first sound reflecting shells being smaller than the angle formed by the tubes.

18. Baffle silencer according to claim 17, further characterized by the tube axes and the axes of the first sound reflecting shells being essentially coincident on the inlet side.

19. Baffle silencer according to claim 18, further characterized by the tubes being located essentially inside the first sound reflecting shells.

20. Baffle silencer according to claim 18, further characterized by the open zones being provided on the second sound reflecting shells on their sides facing away from the associated open zones on the first sound reflecting shells.

21. Baffle silencer according to claim 20, further characterized by the aperture angles of the second sound reflecting shell openings relative to their axes being less than 180°.

22. Baffle silencer according to claim 20, further characterized by the ends of the second sound reflecting shells being sealingly connected to the housing.

23. Baffle silencer according to claim 20, further characterized by the second sound reflecting shells extending at an acute angle to each other.

24. Baffle silencer according to claim 20, further characterized by the angle formed by the second sound reflecting shells being smaller than the angle formed by the first sound reflecting shells.

25. Baffle silencer according to claim 20, further characterized by the axes of the first and second sound reflecting shells being essentially coincident on the outlet side.

26. Baffle silencer according to claim 20, further characterized by the first sound reflecting shells being disposed only partially inside the second sound reflecting shells in such a way that between each of the first sound reflecting shells and longitudinal edges of the second sound reflecting shells there are two separate open zones.

27. Baffle silencer according to claim 20, further characterized by the second sound reflecting shells being surrounded with a clearance by semicylindrical portions of the silencer housing which are joined together by planar housing side walls parallel to each other.

* * * * *